US009901811B2

(12) United States Patent
Shindo

(10) Patent No.: US 9,901,811 B2
(45) Date of Patent: Feb. 27, 2018

(54) PLAYING FIELD FOR TOY TOPS

(71) Applicant: TOMY COMPANY, LTD., Tokyo (JP)

(72) Inventor: Yukihiro Shindo, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 15/442,855

(22) Filed: Feb. 27, 2017

(65) Prior Publication Data

US 2017/0333783 A1 Nov. 23, 2017

(30) Foreign Application Priority Data

May 23, 2016 (JP) ..... 2016-102525

(51) Int. Cl.
*A63F 3/00* (2006.01)
*A63F 9/16* (2006.01)
*A63H 1/02* (2006.01)

(52) U.S. Cl.
CPC *A63F 9/16* (2013.01); *A63H 1/02* (2013.01)

(58) Field of Classification Search
CPC ..... A63F 9/16; A63H 1/02
USPC ..... 273/287, 241, 280
See application file for complete search history.

(56) References Cited

U.S. PATENT DOCUMENTS 4,732,386 A * 3/1988 Rayfiel ..... A63F 3/0625 273/142 H
4,828,258 A * 5/1989 Gebert ..... A63F 9/16 273/108
4,941,665 A * 7/1990 Klamer ..... A63F 5/04 273/142 D
5,549,295 A * 8/1996 Goldring ..... A63F 7/0023 273/109
6,905,389 B2 6/2005 Matsukawa
8,066,543 B2 * 11/2011 Kitamura ..... A63F 9/16 273/110

(Continued)

FOREIGN PATENT DOCUMENTS

EP 2108416 10/2009
JP 3079303 5/2001

(Continued)

OTHER PUBLICATIONS

J-Plat Pat English Language Abstract for JP 2012-000322, published Jan. 5, 2012.

(Continued)

*Primary Examiner* — Vishu Mendiratta
(74) *Attorney, Agent, or Firm* — Staas & Halsey LLP

(57) ABSTRACT

A playing field for moving toy tops includes a playing board, a plurality of turntables, a motor and a power transmission mechanism. The turntables are disposed on the playing board. The power transmission mechanism transmits power of the motor to rotate the turntables. The playing board is formed in a shape of a mortar having a diameter which becomes smaller toward a lower end. The turntables are disposed at points other than a center of the playing board such that upper surfaces incline along the playing board. Rotary shafts of the turntables incline in a direction toward the center of the playing board according to the inclination of the upper surfaces.

17 Claims, 4 Drawing Sheets

(56) References Cited

U.S. PATENT DOCUMENTS

2009/0253343 A1* 10/2009 Kitamura ..... A63F 9/16
446/256

FOREIGN PATENT DOCUMENTS

| | | |
|---|---|---|
| JP | 2013-000284 | 1/2013 |
| JP | 5802367 | 9/2015 |

OTHER PUBLICATIONS

Search Report for corresponding European Patent Application No. 17155624.3, dated Sep. 14, 2017.
J-PlatPat English Abstract for JP 2013-000284, published Jan. 7, 2013.

* cited by examiner

PLAYING FIELD FOR TOY TOPS

CROSS-REFERENCE TO RELATED APPLICATIONS

This application is based upon and claims the benefit of priority under 35 USC 119 of Japanese Patent Application No. 2016-102525 filed on May 23, 2016, the entire disclosure of which, including the specification, claims, drawings and abstract, is incorporated herein by reference in its entirety.

BACKGROUND OF THE INVENTION

1. Field of the Invention

The present invention relates to a playing field for toy tops to play with toy tops by spinning the toy tops and in particular to a playing field for toy tops to play with toy tops by making the toy tops collide with each other.

2. Description of the Related Art

As a playing field for toy tops to play with toy tops by spinning the toy tops, there has been known a playing field for toy tops to play with toy tops by making the toy tops collide with each other. This kind of playing field for toy tops typically has a mortar-shaped playing board and is formed such that toy tops having been released onto the playing board move toward the center. The toy tops having moved toward the center collide with each other, and one of them knocks down the other toy top (s) or hits the other toy top (s) to fly out of the playing board, thereby winning a battle.

However, when the playing board has a simple mortar shape, the toy tops merely move toward the center while spinning. Hence, movements of the toy tops are monotonous. Then, there is provided a playing field for toy tops for which ingenuity has been exercised in changing trajectories (movements) of toy tops. (Refer to, for example, Japanese Patent No. 5802367.)

The playing field for toy tops described in Japanese Patent No. 5802367 has a playing board constituted of: a ring-shaped part having a diameter which becomes smaller toward the lower end; and a turntable disposed in an opening part defined by the lower end of the ring-shaped part, wherein a concave part is formed at a part of the upper surface of the turntable. According to this playing field for toy tops, the toy tops having been released onto the playing board are led to the turntable by inclination of the ring-shaped part and change their trajectories (movements) by centrifugal force of the rotating turntable.

However, providing only one turntable makes movements of toy tops on the turntable almost the same and monotonous, and hence is not enough to increase possibility of collision between toy tops. Therefore, there has been desired an advent of a playing field for toy tops which makes toy tops perform complex movements and increases possibility of collision between toy tops.

SUMMARY OF THE INVENTION

Objects of the present invention include providing a playing field for toy tops which has high possibility of collision between toy tops.

In order to achieve the above and/or other objects, according to an aspect of the present invention, there is provided a playing field for toy tops, including: a playing board for released toy tops to move about; a plurality of turntables disposed on the playing board; a motor; and a power transmission mechanism which transmits power of the motor to the turntables, thereby rotating the turntables, wherein the playing board is formed in a shape of a mortar having a diameter which becomes smaller toward a lower end with a vertical center line kept, the turntables are disposed at points of the playing board other than a center of the playing board, the turntables are disposed such that upper surfaces incline along the playing board, and rotary shafts of the turntables incline in a direction toward the center of the playing board according to the inclination of the upper surfaces.

BRIEF DESCRIPTION OF THE DRAWINGS

The present invention is fully understood from the detailed description given hereinafter and the accompanying drawings, which are given by way of illustration only, and thus are not intended to limit the present invention, wherein.

DETAILED DESCRIPTION

Hereinafter, a playing field for toy tops according to an embodiment of the present invention is described with reference to the drawings.

Figure 1:
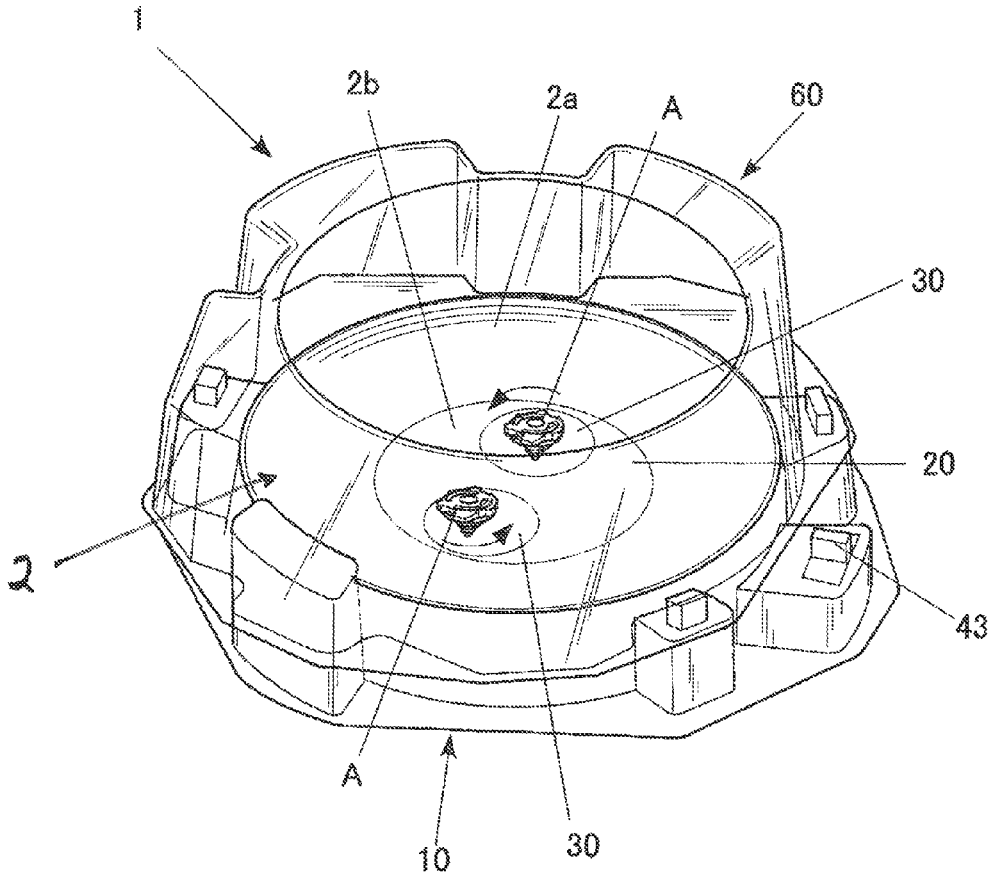
FIG. 1 is a perspective view showing a playing field for toy tops according to an embodiment of the present invention.
Figure 2:
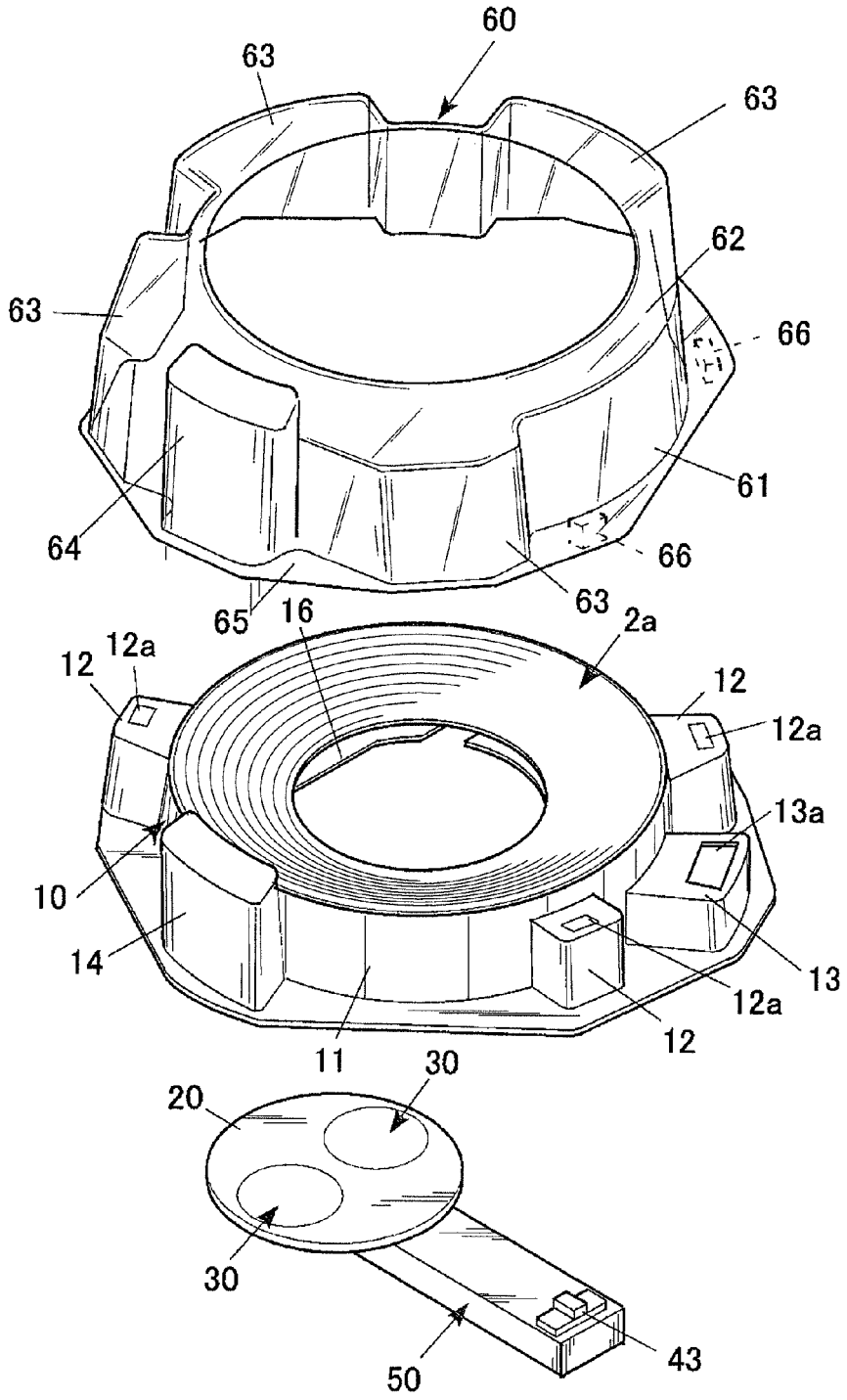
FIG. 2 is an exploded perspective view of the playing field for toy tops of the embodiment.

FIG. 1 is a perspective view showing a playing field for toy tops according to embodiments of the present invention, and FIG. 2 is an exploded perspective view of the playing field for toy tops shown in FIG. 1.

A playing field for toy tops 1 according to an embodiment includes: a base 10 constituting a periphery part of a playing board 2; a disk 20 constituting a center part 2*b* of the playing board 2; two turntables 30 installed inside the disk 20 to be almost flush with the upper surface of the disk 20; a casing 50 which houses a power transmission mechanism 40 (see FIG. 3) for these two turntables 30; and a cover 60 which covers the upper part of the base 10.

As shown in FIG. 2, the base 10 is approximately hollow-cylindrical and provided with, on the upper end, a ring-shaped slope (a part of the playing board) 2*a* having a diameter which becomes smaller toward a lower end relative to a vertical center line. At three points of a surrounding wall 11 of the base 10, support parts 12 are formed. The support parts 12 are projecting outward in the radius direction and support the lower end of the cover 60. On the surrounding wall 11 of the base 10, a projecting part 13 is also formed between two of the support parts 12. In the projecting part 13, a part of the casing 50 is housed. Further, on the base 10, a positioning wall 14 formed of a part of the surrounding wall 11 projecting upward as well as outward in the radius direction is formed.

The disk 20 is fixed to one end of the casing 50. The upper surface of the disk 20 is formed of a curved surface having a diameter which becomes smaller toward a lower end relative to a vertical center line. The disk 20 is fitted to a circular lower end (lower-end opening) of the ring-shaped slope 2*a* on the base 10. The turntables 30 are disposed at two points of the disk 20 in the diameter direction of the disk 20, the two points being other than the center of the disk 20. The upper surfaces of the turntables 30 are not particularly limited to flat surfaces.

Figure 3:
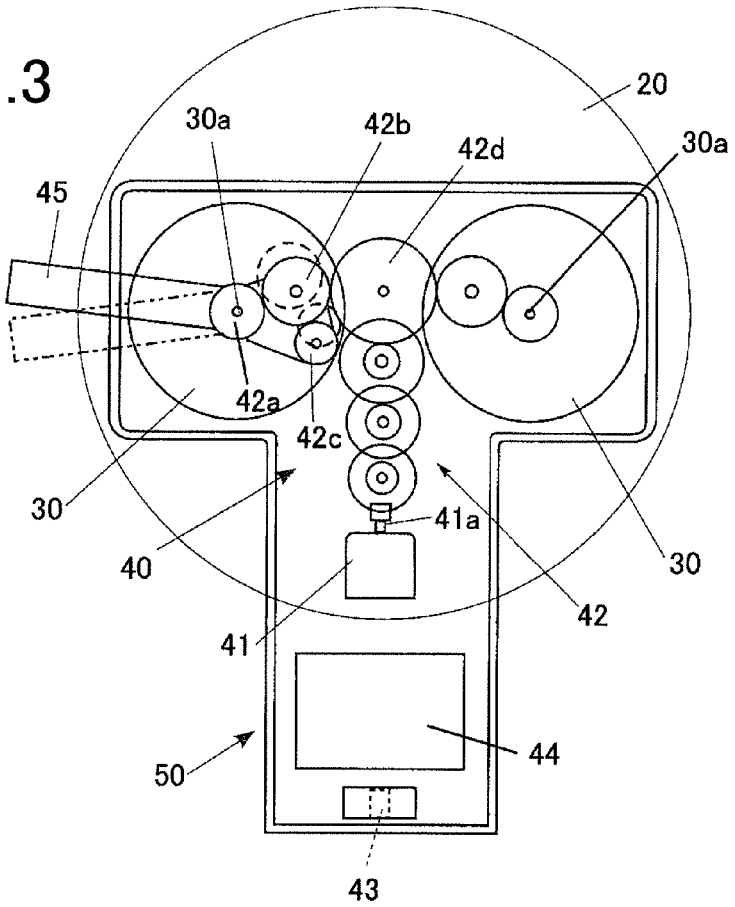
FIG. 3 is a schematic view showing a power transmission mechanism for turntables in the playing field for toy tops of the embodiment.

As shown in FIG. 3, in the casing 50, a motor 41 (which may function as a change mechanism) having a drive shaft 41*a*, a gear train 42 which transmits power of the motor 41 to the turntables 30, thereby rotating the turntables 30, and a power switch 43 for the motor 41 are installed, and a battery housing part 44 is formed between the motor 41 and the power switch 43. The gear train 42 is a part of the power transmission mechanism 40. The motor 41 is a motor capable of positive rotation and negative rotation, and the power switch 43 doubles as a switch to change the rotation direction of the motor 41. That is, when the power switch 43 is at its neutral position, the motor 41 (power) is off, when the power switch 43 is moved in one direction from the neutral position, the motor 41 rotates in one direction, and when the power switch 43 is moved in the other direction from the neutral position, the motor 41 rotates in the other direction.

The motor 41 may not be a motor capable of positive rotation and negative rotation, and such motors 41 may be provided for the number of turntables 30. Alternatively, if there are three or more turntables 30, the motor 41 capable of positive rotation and negative rotation may be used for some of the turntables 30. Further, instead of or in addition to the rotation direction, the rotation speed of the motor(s) 41 may be changeable.

On the power transmission mechanism 40, a lever 45 (a change mechanism) is disposed. The lever 45 is supported by a rotary shaft 30*a* of one of the turntables 30 to be rotatable on the rotary shaft 30*a*. On one end of the lever 45, a movable idler gear 42*b* which constantly meshes with a gear 42*a* attached to the turntable 30 and an auxiliary gear 42*c* which constantly meshes with the movable idler gear 42*b* are installed. When the lever 45 is rotated in one direction (to the position indicated by a solid line), the movable idler gear 42*b* meshes with a motor-side idler gear 42*d*, and the auxiliary gear 42*c* separates from the motor-side idler gear 42*d*. On the other hand, when the lever 45 is rotated in the other direction (to the position indicated by a two-dot chain line), the movable idler gear 42*b* separates from the motor-side idler gear 42*d*, and the auxiliary gear 42*c* meshes with the motor-side idler gear 42*d*.

Thus, by operating the lever 45, the two turntables 30 can be rotated in the same direction or in the opposite directions to each other. In the case shown in FIG. 3 where the gear 42*b* and the gear 42*c* are different from each other in size (the number of teeth), by operating the lever 45, the rotation speeds of the turntables 30 are also changed. Note that, in the embodiment, one turntable 30 is provided with the reversal mechanism (lever 45, etc.), but the other turntable 30 may also be provided with the reversal mechanism.

The rotation directions of the turntables 30 exert a great influence on rotation (spin) of toy tops A. The rotation (spin) direction of a toy top A is clockwise or anticlockwise when viewed from above. If the rotation direction of a turntable 30 and the rotation direction of a toy top A are different from each other, the rotation speed of the toy top A increases, whereas if the rotation direction of a turntable 30 and the rotation direction of a toy top A are the same, the rotation speed of the toy top A decreases. That is, if two turntables 30 rotate in the same direction, it is advantageous to a toy top A which rotates in one direction, but disadvantageous to another toy top A which rotates in the other direction. Then, a fair battle cannot be fought. Therefore, if toy tops A having rotation directions opposite to each other are going to fight a battle and there are two turntables 30, it is preferable that these turntables 30 be rotated in the opposite directions to each other.

Figure 4:
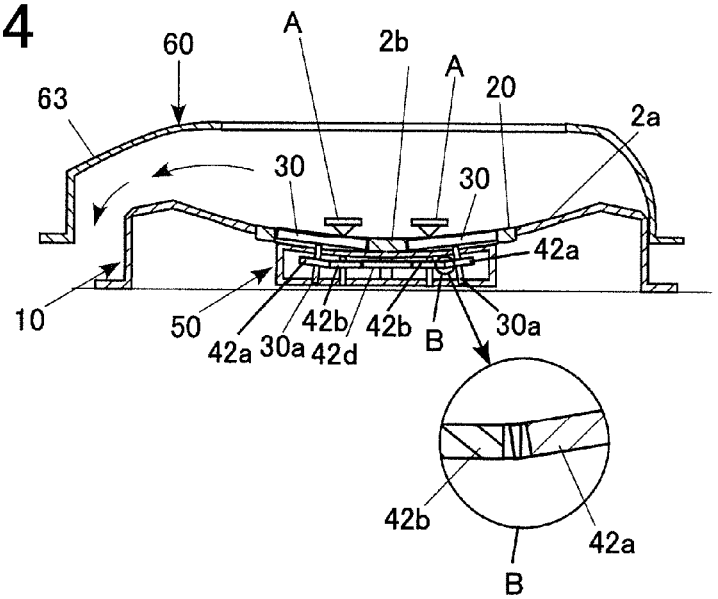
FIG. 4 is a schematic vertical cross-sectional view of the playing field for toy tops shown in FIG. 1.

Here, as shown in FIG. 4, the disk 20 of the embodiment, the disk 20 constituting the center part (a part of the playing board) 2*b*, is formed of a curved surface having a diameter which becomes smaller toward the lower end with the vertical center line. The turntables 30 incline along the center part 2*b* of the playing board 2, and the rotary shafts 30*a* of the turntables 30 incline accordingly. Therefore, the gears 42*a* attached to the turntables 30 are to mesh with the gears 42*b* of the gear train 42 in the inclining state with respect to the gears 42*b*. However, the inclination of the gears 42*a* with respect to the gears 42*b* is small. Hence, as shown in B part enlarged in FIG. 4, either the gears 42*a* or the gears 42*b* are inclined so that the gears 42*a* and the gears 42*b* can mesh with each other.

Thus-configured casing 50, to which the disk 20 is fixed, is installed in the base 10 as follows.

First, a bar part of the casing 50 fits under the ring-shaped slope 2*a* of the playing board 2 from above a large hole of in a center part of the base 10. Then, the disk 20 is fitted to the circular lower end of the ring-shaped slope 2*a* from above, the edge part of the disk 20 is partly placed on a shelf 16 formed in the base 10, and the power switch 43 is exposed from a hole 13*a* of the projecting part 13 of the base 10. Thus, the casing 50 is installed in the base 10.

Next, the cover 60 is described.

The cover 60 is made of a transparent synthetic resin to be see-through. This cover 60 has a surrounding wall 61 which touches the outer surface of the surrounding wall 11 of the base 10. The cover 60 has, at an upper part, a ring-shaped ceiling wall 62 overhanging in a central direction. The ceiling wall 62 covers an upper outer edge part of the ring-shaped slope 2*a* on the base 10. At some points of the surrounding wall 61 of the cover 60, swelling parts 63 which are projecting outward in a radius direction and a swelling part 64 which covers the positioning wall 14 of the base 10 are formed. On a lower end of the surrounding wall 61, a flange 65 which is projecting outward in the radius direction is formed, and on the flange 65, connection parts 66 which are fitted to fastening parts 12*a* of the support parts 12 of the base 10 are formed.

In the thus-configured playing field for toy tops 1, by operating the power switch 43, the motor 41 is driven, which rotates the turntables 30 via the gear train 42. The motor 41 is a motor capable of positive rotation and negative rotation, and the rotation directions of the turntables 30 change according to the rotation direction of the motor 41.

When toy tops A are released onto the playing board 2 in this state (motor-driven state), the toy tops A are led to the center part 2*b*, which is constituted of the disk 20, by the ring-shaped slope 2*a*. When the toy tops A on the center part 2*b* move onto the turntable (s) 30, the toy tops A revolve on and around the turntable(s) 30 along the border(s) between the turntable(s) 30 and the center part 2*b*.

Figure 5:
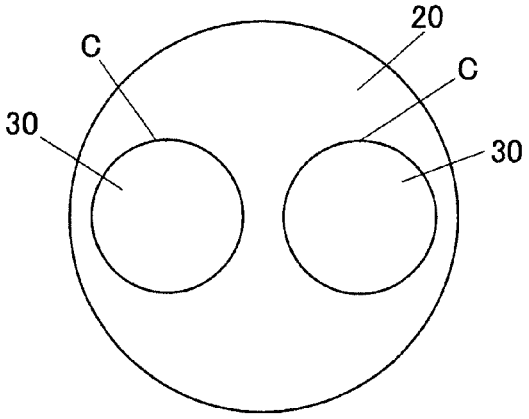
FIG. 5 is a plan view of a disk in the playing field for toy tops.

That is, in the above-described case where the center part 2*b*, which is constituted of the disk 20, is curved and the upper surfaces of the turntables 30 are flat surfaces, steps are generated at some points between the turntables 30 and the disk 20 (at some points of C parts shown in FIG. 5). Consequently, the toy tops A on the turntable(s) 30 move and revolve along the step(s), and (i) when reaching point(s) with no step by centrifugal force or (ii) by climbing over the step(s) by an increase in the centrifugal force, the toy tops A are thrown out of the turntable(s) 30. Thus, trajectories of the toy tops A change, and a possibility of collision between the toy tops A increases.

The thrown-out toy tops A collide with each other, so that one of the toy tops A gets pushed out of the way, namely, is hit to fly out. However, toy top A falls around (near) the base 10 by being guided by the swelling part(s) 63 of the cover 60. Hence, the toy top A does not scatter in all directions.

In the above, an embodiment of the present invention is described. Needless to say, however, the present invention is not limited to the embodiment and can be appropriately modified in various aspects without departing from the spirit of the present invention.

For example, although two turntables 30 are disposed in the disk 20 in the above embodiment, three or more turntables 30 may be disposed.

Further, although the turntables 30 are disposed in the disk 20 in the above embodiment, the disk 20 and the base 10 may be formed as a single unit, and the turntables 30 may be disposed in the playing board 2.

Figure 6:
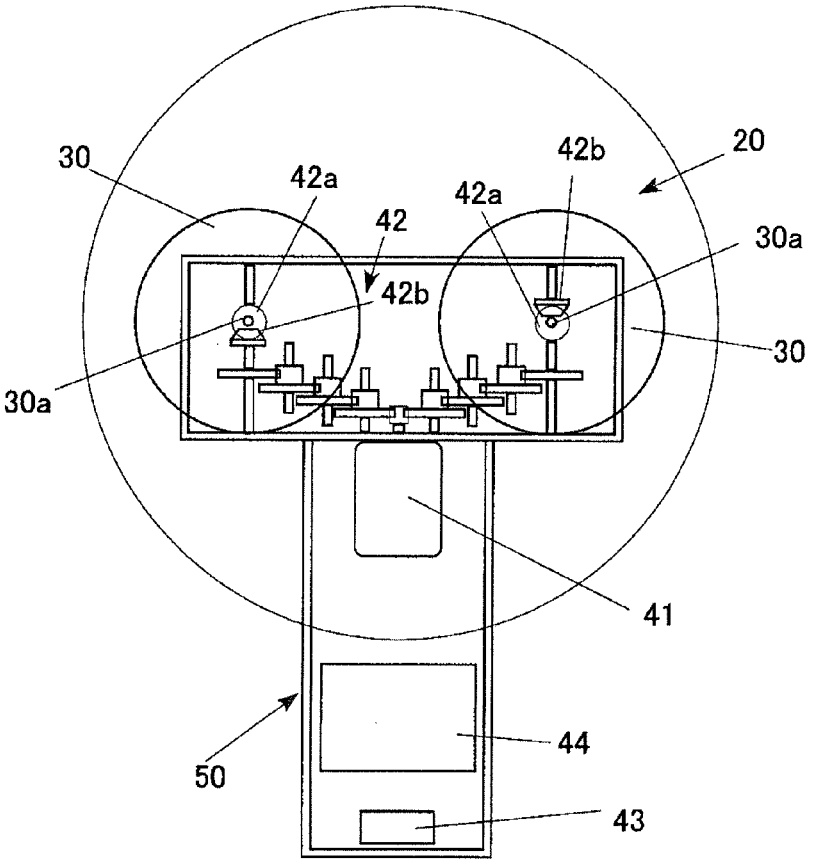
FIG. 6 is a schematic view showing a power transmission mechanism for the turntables in the playing field for toy tops according to another embodiment.

Further, although the shafts of the gears constituting the gear train 42 are each configured to extend in the up-down direction in the above embodiment, if the inclination of the gears 42*a* with respect to the gears 42*b* is large, the shafts thereof may be each configured to extend in the lateral direction, and the gears 42*a* and 42*b* may mesh with each other by utilizing bevel gears as shown in FIG. 6. That is, bevel gears or the like are used as the gears 42*a* attached to the rotary shafts 30*a* and the idler gears 42*b* which mesh with the gears 42*a*, thereby changing directions of the rotary shafts 30*a*. Consequently, the idler gears 42*b* can easily mesh with the gears 42*a* when the rotary shafts 30*a* incline.

Further, although power of the motor 41 is transmitted to the turntables 30 via the gear-type mechanism in the above embodiment, the power may be transmitted to the turntables 30 via a belt-type mechanism or the like.

According to an aspect of the present invention, there is provided a playing field for toy tops, including: a playing board for released toy tops to move about; a plurality of turntables disposed on the playing board; a motor; and a power transmission mechanism which transmits power of the motor to the turntables, thereby rotating the turntables, wherein the playing board is formed in a shape of a mortar having a diameter which becomes smaller toward a lower end of a vertical center line, the turntables are disposed at points of the playing board other than a center of the playing board, the turntables are disposed such that upper surfaces incline along the playing board, and rotary shafts of the turntables incline in a direction toward the center of the playing board according to the inclination of the upper surfaces. A power source for the motor may be included in the playing field for toy tops or may be an external power source.

Preferably, the upper surfaces of the turntables are flat surfaces.

According to the playing field for toy tops of the present invention, the plurality of turntables can change trajectories of toy tops, which can increase the possibility of collision between toy tops.

Further, according to the playing field for toy tops of the present invention, the turntables can catch toy tops on the mortar-shaped playing board while the toy tops are on the way to the center of the playing board, which can make toy tops perform complex movements.

Preferably, the playing field for toy tops further includes a change mechanism to change at least one of a rotation direction and a rotation speed of at least one of the turntables.

According to the above playing field for toy tops of the present invention, the rotation directions of the turntables can be changed, which can make toy tops perform more complex movements.

Preferably, the turntables are rotatable in directions different from each other.

According to the above playing field for toy tops of the present invention, the turntables are rotatable in directions different from each other, which can eliminate the relative merits of toy tops that rotate in directions different from each other and hence can realize fair and enjoyable battles.

Preferably, the playing board is constituted of: a ring-shaped slope having a diameter which becomes smaller toward a lower end of a vertical center line; and a disk fitted to a lower-end opening of the ring-shaped slope and having a diameter which becomes smaller toward a lower end of the vertical center line, and the turntables are disposed in the disk.

According to the above playing field for toy tops of the present invention, the turntables are disposed in the disk, which allows the disk and the turntables to be handled as a single unit and hence makes assembly work easy.

Preferably, the playing field for toy tops further includes a casing and a power switch, wherein the disk is disposed on one end of the casing, the casing houses: the motor; and the power transmission mechanism constituted of a gear train connecting a drive shaft of the motor with the rotary shafts of the turntables, and the power switch is disposed on another end of the casing.

According to the above playing field for toy tops of the present invention, the motor, the power transmission mechanism and the power switch are all housed in the casing, which makes the assembly work easier.

Preferably, the playing field for toy tops further includes a cover which has an opening at a center part and covers the playing board.

According to the above playing field for toy tops of the present invention, the cover can control the flying direction or the like of toy tops.

Preferably, the playing field for toy tops further includes a base, wherein a surrounding wall of the cover partly swells outward in a radius direction, thereby forming a swelling part, and a space through which the toy tops fall is formed between the swelling part and a surrounding wall of the base.

According to the above playing field for toy tops of the present invention, the wall of the swelling part guides, around the base, toy tops having been sent flying, which can certainly prevent toy tops from scattering in all directions.

What is claimed is:

1. A playing field for toy tops, comprising:

a playing board for toy tops to directly move on an upper surface thereof, the playing board including a base having a downwardly sloped upper surface, a disk having an upper curved surface, and a plurality of turntables, each turntable having a flat upper surface;

a motor; and a power transmission mechanism which transmits power of the motor to the turntables, thereby rotating the turntables relative to but within the disk which is stationary and relative to the base which is stationary, wherein the turntables are disposed entirely within the disc at points of the disk other than a center of the disk, the turntables are disposed such that upper surfaces thereof incline along the disk, the upper surfaces of the base, the disk and the turntables form the upper surface of the playing board upon which the toy tops move, rotary shafts of the turntables incline in a direction toward the center of the playing board according to the inclination of the upper surfaces of the turntables, and the turntables are disposed in the disk to be substantially flush with the upper surface of the disk, but with a step is formed between the upper surfaces of the turntables and the upper surface of the disk.

2. The playing field for toy tops according to claim 1, further comprising a change mechanism to change at least one of a rotation direction and a rotation speed of at least one of the turntables.

3. The playing field for toy tops according to claim 2, wherein the change mechanism can selectively control the power transmission mechanism to rotate the turntables in directions opposite from each other.

4. The playing field for toy tops according to claim 2, wherein the change mechanism includes a lever.

5. The playing field for toy tops according to claim 1, wherein the base includes:

a ring-shaped slope having a diameter which becomes smaller toward a lower end of the slope relative to the vertical center line; and the disk is fitted to a lower-end opening of the ring-shaped slope and having a diameter which becomes smaller toward a lower end of the slope relative to the vertical center line.

6. The playing field for toy tops according to claim 5, further comprising:

a casing and a power switch, wherein the disk is disposed on one end of the casing, the casing houses the motor, the power transmission mechanism includes a gear train connecting a drive shaft of the motor with the rotary shafts of the turntables, and the power switch is disposed on another end of the casing.

7. The playing field for toy tops according to claim 1, further comprising a cover which has an opening at a center part and covers the playing board.

8. The playing field for toy tops according to claim 7, wherein a surrounding wall of the cover partly swells outward in a radius direction, thereby forming a swelling part, and a space through which the toy tops fall is formed between the swelling part and a surrounding wall of the base.

9. A playing field for toy tops, comprising:

a playing board for toy tops to directly move thereon, the playing board including— a base having an upper surface with an opening formed substantially centrally therein;

a disk located within the opening and having a curved upper surface;

a plurality of turntables disposed at fixed places entirely within the disc, respectively, other than a center of the disc, wherein each of the turntables has a flat upper surface;

a motor; and a power transmission mechanism that rotates the turntables in the fixed places within the disc, as the disc and the base remain stationary, the turntables are disposed such that upper surfaces thereof incline along the upper surface of the disk, and wherein a border is formed between the flat surface of each of the turntables and the curved surface of the disk, over which the toy tops move as the turntables rotate.

10. The playing field for toy tops according to claim 9, further comprising a change mechanism to change at least one of a rotation direction and a rotation speed of at least one of the turntables.

11. The playing field for toy tops according to claim 10, wherein the change mechanism causes the turntables to rotate in directions opposite from each other.

12. The playing field for toy tops according to claim 10, wherein the change mechanism includes a lever.

13. The playing field for toy tops according to claim 9, wherein the base includes:

a ring-shaped slope having a diameter which becomes smaller toward a lower end of the slope relative to the vertical center line; and the disk is fitted to a lower-end opening of the ring-shaped slope and having a diameter which becomes smaller toward a lower end of the slope relative to the vertical center line.

14. The playing field for toy tops according to claim 13, further comprising:

a casing and a power switch, wherein the disk is disposed on one end of the casing, the casing houses the motor, the power transmission mechanism includes a gear train connecting a drive shaft of the motor with the rotary shafts of the turntables, and the power switch is disposed on another end of the casing.

15. The playing field for toy tops according to claim 9, further comprising a cover which has an opening at a center part and covers the playing board.

16. The playing field for toy tops according to claim 15, wherein a surrounding wall of the cover partly swells outward in a radius direction, thereby forming a swelling part, and a space through which the toy tops fall is formed between the swelling part and a surrounding wall of the base.

17. A playing field for toy tops, comprising:

a playing board for toy tops to directly move thereon, the playing board including— a base having a downwardly-sloped upper surface and an opening formed therein;

a disk located within the opening and having a curved upper surface;

a plurality of turntables disposed at fixed places within the disc, respectively, other than a center of the disc, wherein each of the turntables has a flat upper surface;

a motor;

a power transmission mechanism that rotates the turntables in the fixed places in the disc, as the disc and the base remain stationary, the turntables are disposed entirely within the disc at the fixed places that are at points of the disk other than a center of the disk, the turntables are disposed such that upper surfaces thereof incline along the upper surface of the disk, and wherein a border is formed between the flat surface of each turntable and the curved surface of the disk, over which the toy tops move; and a change mechanism to change at least one of a rotation direction and a rotation speed of at least one of the turntables, wherein the change mechanism causes the turntables to rotate in directions opposite from each other.

* * * * *